US010789909B2

(12) United States Patent
Yen et al.

(10) Patent No.: US 10,789,909 B2
(45) Date of Patent: Sep. 29, 2020

(54) PICTURE ADJUSTING METHOD AND DISPLAY SYSTEM

(71) Applicant: QISDA CORPORATION, Taoyuan (TW)

(72) Inventors: Chung-Ting Yen, New Taipei (TW); Feng-Lin Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 23 days.

(21) Appl. No.: 16/299,169

(22) Filed: Mar. 12, 2019

(65) Prior Publication Data

US 2020/0202811 A1 Jun. 25, 2020

(30) Foreign Application Priority Data

Dec. 20, 2018 (CN) ..... 2018 1 1560201

(51) Int. Cl.
*G09G 5/04* (2006.01)

(52) U.S. Cl.
CPC ..... *G09G 5/04* (2013.01); *G09G 2320/0673* (2013.01); *G09G 2320/0686* (2013.01)

(58) Field of Classification Search
CPC ..... G09G 5/026; G09G 5/02; G09G 2340/06; G09G 2340/0428; G09G 2310/027; G09G 2360/16; G09G 2360/145; G09G 2330/028; G09G 3/3607; G09G 3/3696; G09G 3/3406; G09G 3/20; G09G 3/3225; G09G 3/3291; G09G 3/2003; G09G 3/2007; G09G 3/2022; G09G 3/2011; G09G 3/3413; G09G 3/364; G09G 3/3648; G09G 3/007; G09G 3/2074; G09G 2320/0242; G09G 2320/0666; G09G 2320/0223; G09G 2320/0626; G09G 2320/0233; G09G 2320/0271; G09G 2320/028; G09G 2320/068; G09G 2320/04; G09G 2320/0673; G09G 2320/02; G09G 2320/0276; G09G 2320/0285; G09G 2320/0646; G09G 2300/0452; G09G 2300/0447; G09G 2300/0439;

(Continued)

(56) References Cited

U.S. PATENT DOCUMENTS 6,633,343 B2 * 10/2003 Ito ..... H04N 5/202 348/671
9,940,870 B2 * 4/2018 Yano ..... G09G 3/3208

(Continued)

*Primary Examiner* — Nitin Patel
*Assistant Examiner* — Amen Woldesenbet Bogale

(57) ABSTRACT

A picture adjusting method includes steps of measuring a plurality of first original parameters in a first picture and measuring a plurality of second original parameters in a second picture for a plurality of color patterns; calculating a first gain factor according to the first original parameters and the second original parameters of at least one of the color patterns except a black pattern; subtracting a product of the first original parameters of the black pattern and the first gain factor from the second original parameters of the black pattern to obtain a plurality of first offset values; adding the first offset values to the first original parameters of each color pattern to obtain a plurality of first updated parameters in the first picture; and multiplying the first updated parameters by a second gain factor to obtain a plurality of first adjusted parameters in the first picture.

32 Claims, 3 Drawing Sheets

(58) Field of Classification Search
CPC ..... G09G 2300/0443; G02F 2001/134345; G06T 1/20; H04N 9/64
See application file for complete search history.

(56) References Cited

U.S. PATENT DOCUMENTS

| | | | | |
|---|---|---|---|---|
| 2003/0052868 | A1* | 3/2003 | Kagawa | G09G 5/02 345/204 |
| 2003/0156225 | A1* | 8/2003 | Ito | G06T 5/009 348/649 |
| 2005/0093991 | A1* | 5/2005 | Yokohata | H04N 5/361 348/222.1 |
| 2018/0286325 | A1* | 10/2018 | Koudo | G09G 3/3607 |

* cited by examiner

PICTURE ADJUSTING METHOD AND DISPLAY SYSTEM

BACKGROUND OF THE INVENTION

1. Field of the Invention

The invention relates to a picture adjusting method and a display system and, more particularly, to a picture adjusting method and a display system capable of reducing brightness difference between two pictures.

2. Description of the Prior Art

At present, some display devices are capable of displaying a plurality of pictures in a picture by picture (PBP) manner, a picture in picture (PIP) manner, etc., for a user. When displaying a picture, the display device usually performs a gamma correction for the picture to adjust the brightness of the picture. However, if the brightness of two pictures is adjusted by an identical gamma curve, the brightness of the two pictures after adjustment may be different, such that the user may feel difference in vision as watching the two pictures.

SUMMARY OF THE INVENTION

An objective of the invention is to provide an image processing method and a display device capable of reducing brightness difference between two pictures, so as to solve the aforesaid problems.

According to an embodiment of the invention, a picture adjusting method comprises steps of displaying a first picture and a second picture; measuring a plurality of first original parameters in the first picture and measuring a plurality of second original parameters in the second picture for each of a plurality of color patterns, wherein the color patterns comprise a black pattern; calculating a first gain factor according to the first original parameters and the second original parameters of at least one of the color patterns except the black pattern; subtracting a product of the first original parameters of the black pattern and the first gain factor from the second original parameters of the black pattern to obtain a plurality of first offset values; adding the first offset values to the first original parameters of each color pattern to obtain a plurality of first updated parameters of each color pattern in the first picture; and multiplying the first updated parameters of each color pattern by a second gain factor to obtain a plurality of first adjusted parameters of each color pattern in the first picture.

According to another embodiment of the invention, a display system comprises a display module, a measuring unit and a processing unit. The display module displays a first picture and a second picture. The measuring unit measures a plurality of first original parameters in the first picture and measures a plurality of second original parameters in the second picture for each of a plurality of color patterns, wherein the color patterns comprise a black pattern. The processing unit calculates a first gain factor according to the first original parameters and the second original parameters of at least one of the color patterns except the black pattern. The processing unit subtracts a product of the first original parameters of the black pattern and the first gain factor from the second original parameters of the black pattern to obtain a plurality of first offset values. The processing unit adds the first offset values to the first original parameters of each color pattern to obtain a plurality of first updated parameters of each color pattern in the first picture. The processing unit multiplies the first updated parameters of each color pattern by a second gain factor to obtain a plurality of first adjusted parameters of each color pattern in the first picture.

As mentioned in the above, when displaying two pictures, the invention calculates the gain factors and the offset values according to the color patterns (e.g. black pattern, white pattern, red pattern, green pattern, blue pattern, etc.) in the two pictures and then adjusts the original parameters of each color pattern by the gain factors and the offset values. Accordingly, the invention can reduce brightness difference between the two pictures, such that the user will not feel obvious difference in vision as watching the two pictures.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
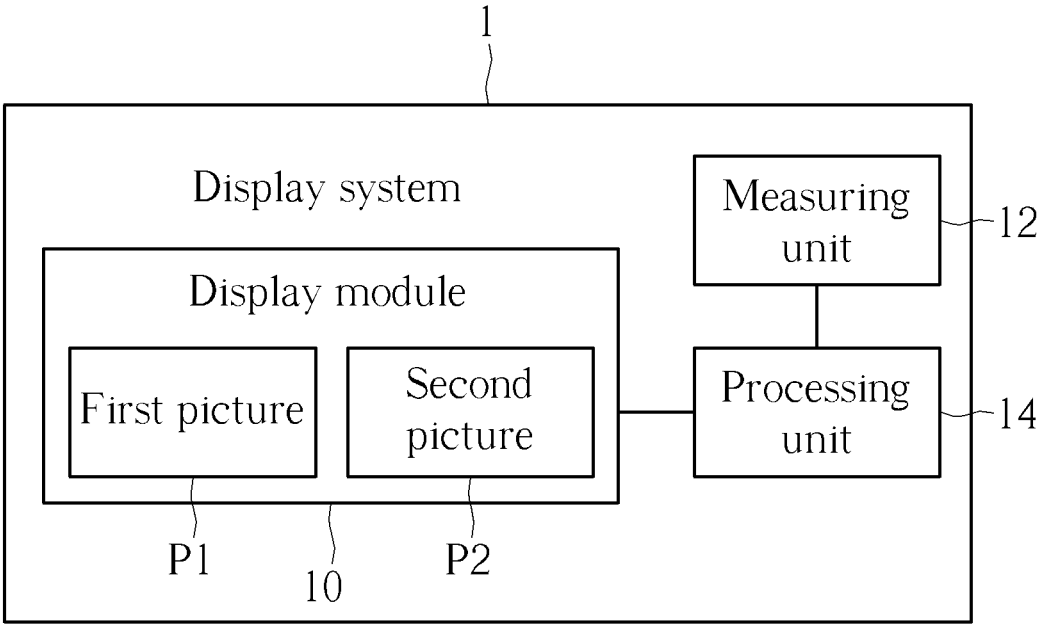
FIG. 1 is a functional block diagram illustrating a display system according to an embodiment of the invention.
Figure 2:
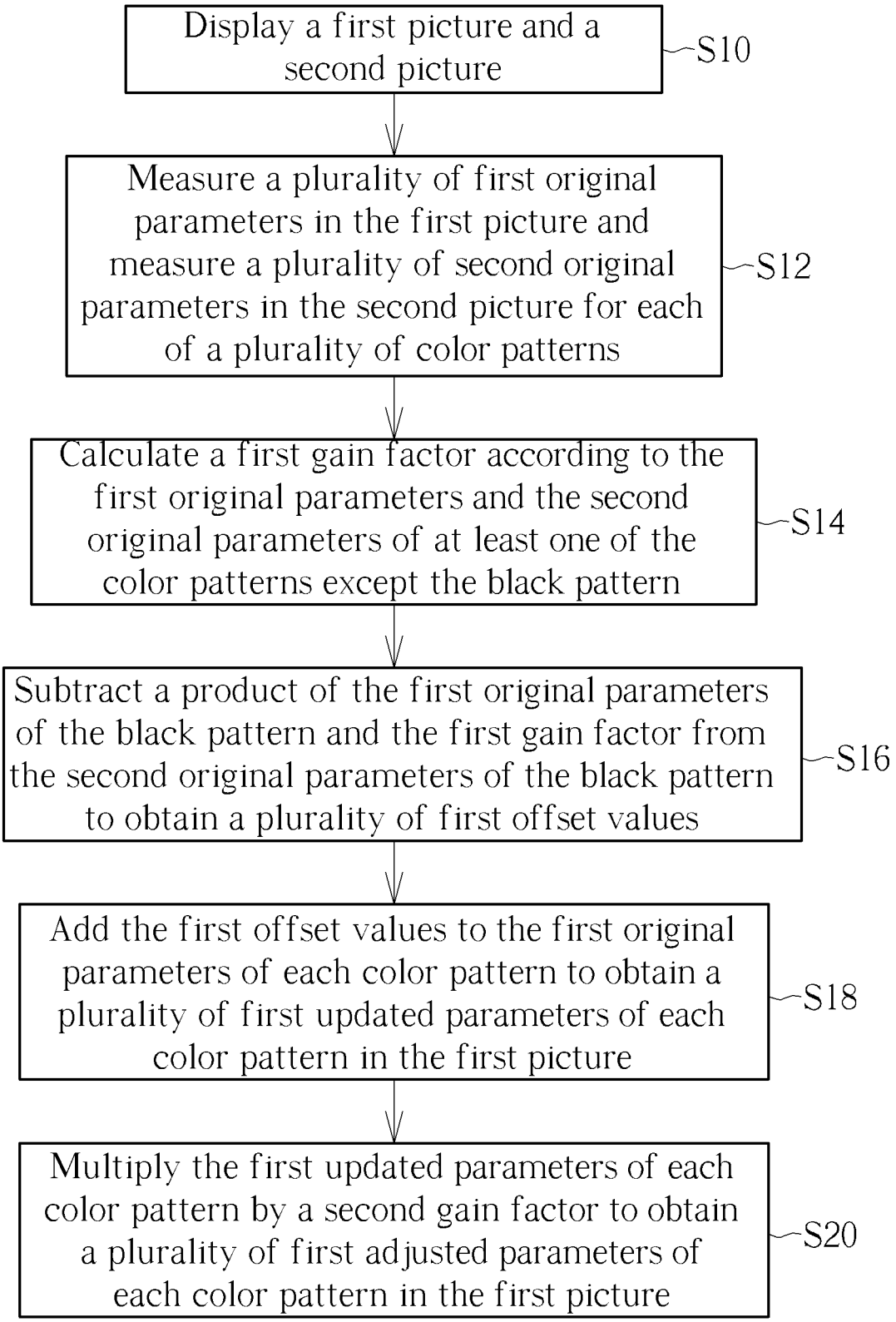
FIG. 2 is a flowchart illustrating a picture adjusting method according to an embodiment of the invention.

Referring to FIGS. 1 and 2, FIG. 1 is a functional block diagram illustrating a display system 1 according to an embodiment of the invention and FIG. 2 is a flowchart illustrating a picture adjusting method according to an embodiment of the invention. The picture adjusting method shown in FIG. 2 is adapted to the display system 1 shown in FIG. 1.

As shown in FIG. 1, the display system 1 comprises a display module 10, a measuring unit 12 and a processing unit 14. The display module 10 is configured to display a first picture P1 and a second picture P2 (step S10 in FIG. 2). In this embodiment, the display module 10 may be a display panel, wherein the first picture P1 and the second picture P2 may be displayed on the display panel in a picture by picture (PBP) manner, a picture in picture (PIP) manner, or other manners. At this time, the processing unit 14 may be disposed in the display panel or connected to the display panel externally. In another embodiment, the display module 10 may comprise two display devices, wherein the first picture P1 is displayed by one of the two display devices and the second picture P2 is displayed by another one of the two display devices. At this time, the processing unit 14 may be disposed in one of the two display devices or connected to the two display devices externally. Furthermore, the measuring unit 12 may be a color measuring instrument.

After displaying the first picture P1 and the second picture P2, the invention uses the measuring unit 12 to measure a plurality of first original parameters in the first picture P1 and measures a plurality of second original parameters in the second picture P2 for each of a plurality of color patterns (step S12 in FIG. 2). In this embodiment, the color patterns may comprise a black pattern W0, a white pattern W255, a red pattern R255, a green pattern G255 and a blue pattern B255. In an embodiment, the first original parameters of each color pattern in the first picture P1 may be represented by Table 1 below and the second original parameters of each color pattern in the second picture P2 may be represented by Table 2 below, wherein X, Y and Z are stimulus values of red, green and blue in CIE 1931 color space.

TABLE 1

| First picture P1 | | | |
|---|---|---|---|
| | First original parameter | | |
| Color pattern | X1 | Y1 | Z1 |
| Black pattern W0 | 0.261795 | 0.25557 | 0.516547 |
| White pattern W255 | 237.8584 | 248.5469 | 299.2774 |
| Red pattern R255 | 104.1663 | 52.79401 | 2.770775 |
| Green pattern G255 | 85.05317 | 177.6342 | 28.58803 |
| Blue pattern B255 | 48.44732 | 17.95661 | 267.6385 |

TABLE 2

| Second picture P2 | | | |
|---|---|---|---|
| | Second original parameter | | |
| Color pattern | X2 | Y2 | Z2 |
| Black pattern W0 | 0.246363 | 0.238195 | 0.486357 |
| White pattern W255 | 226.7696 | 236.7351 | 287.4714 |
| Red pattern R255 | 98.24092 | 49.76382 | 2.656363 |
| Green pattern G255 | 81.77143 | 169.6433 | 27.21642 |
| Blue pattern B255 | 46.6137 | 17.20572 | 257.3841 |

Then, the processing unit 14 calculates a first gain factor according to the first original parameters and the second original parameters of at least one of the color patterns except the black pattern W0 (step S14 in FIG. 2). In this embodiment, the processing unit 14 may calculate a ratio of each second original parameter to each first original parameter of at least one of the white pattern W255, the red pattern R255, the green pattern G255 and the blue pattern B255 to obtain a plurality of ratios. Then, the processing unit 14 may take a specific value from the ratios to be the first gain factor, wherein the specific value may be a minimum value, a maximum value, an average value, a median value or other values. As shown in Table 3 below, the processing unit 14 may calculate a ratio of each second original parameter to each first original parameter of the white pattern W255, the red pattern R255, the green pattern G255 and the blue pattern B255 to obtain a plurality of ratios. At this time, the specific value served as the first gain factor may be a minimum value 0.942604, a maximum value 0.962152, an average value 0.955109, a median value 0.956599 or other values in Table 3.

TABLE 3

| | Ratio of second original parameter to first original parameter | | |
|---|---|---|---|
| Color pattern | X2/X1 | Y2/Y1 | Z2/Z1 |
| White pattern W255 | 0.953381 | 0.952477 | 0.960552 |

TABLE 3-continued

| | Ratio of second original parameter to first original parameter | | |
|---|---|---|---|
| Color pattern | X2/X1 | Y2/Y1 | Z2/Z1 |
| Red pattern R255 | 0.943116 | 0.942604 | 0.958708 |
| Green pattern G255 | 0.961409 | 0.955014 | 0.952022 |
| Blue pattern B255 | 0.962152 | 0.958183 | 0.961685 |

In another embodiment, the processing unit 14 may calculate a ratio of each second original parameter to each first original parameter of the white pattern W255 to obtain a plurality of ratios. Then, the processing unit 14 may take a matrix consisting of the ratios to be the first gain factor. As shown in Table 4 below, the matrix served as the first gain factor is [0.953381 0.952477 0.960552]. Needless to say, the processing unit 14 may also take a minimum value, a maximum value, an average value, a median value or other values in Table 4 to be the first gain factor.

TABLE 4

| | Ratio of second original parameter to first original parameter | | |
|---|---|---|---|
| Color pattern | X2/X1 | Y2/Y1 | Z2/Z1 |
| White pattern W255 | 0.953381 | 0.952477 | 0.960552 |

In another embodiment, a first matrix $$\begin{bmatrix} 104.1663 & 52.79401 & 2.770775 \\ 85.05371 & 177.6342 & 28.58803 \\ 48.44732 & 17.95661 & 267.6385 \end{bmatrix}$$

may consist of the first original parameters of the red pattern R255, the green pattern G255 and the blue pattern B255, and a second matrix $$\begin{bmatrix} 98.24092 & 49.76382 & 2.656363 \\ 81.77143 & 169.6433 & 27.21642 \\ 46.6137 & 17.20572 & 257.3841 \end{bmatrix}$$

may consist of the second original parameters of the red pattern R255, the green pattern G255 and the blue pattern B255. Then, the processing unit 14 may multiply the second matrix by an inverse matrix of the first matrix and sets negative value(s) to be zero, so as to obtain a third matrix $$\begin{bmatrix} 0.943189 & 0 & 0.000181 \\ 0.006982 & 0.952957 & 0 \\ 0.000642 & 0 & 0.961738 \end{bmatrix}.$$

Then, the processing unit may take the third matrix to be the first gain factor.

In the following, the maximum value 0.962152 in Table 3 is taken to be the first gain factor to illustrate the steps after the step S14. After obtaining the first gain factor, the processing unit 14 subtracts a product of the first original parameters of the black pattern W0 and the first gain factor from the second original parameters of the black pattern W0 to obtain a plurality of first offset values (step S16 in FIG. 2). It is assumed that the first gain factor is represented by G1, so the calculation and result of the first offset values are shown in Table 5 below.

TABLE 5

| Black pattern | Subtract product of first original parameter and first gain factor from second original parameter | | |
|---|---|---|---|
| W0 | X2 − X1 * G1 | Y2 − Y1 * G1 | Z2 − Z1 * G1 |
| First offset value | −0.00552 | −0.0077 | −0.01064 |

Then, the processing unit 14 adds the first offset values to the first original parameters of each color pattern to obtain a plurality of first updated parameters of each color pattern in the first picture P1 (step S18 in FIG. 2), as shown in Table 6 below.

TABLE 6

| First picture P1 | | | |
|---|---|---|---|
| | First updated parameter | | |
| Color pattern | X1' = X1 − 0.0052 | Y1' = Y1 − 0.0077 | Z1' = Z1 − 0.01064 |
| Black pattern W0 | 0.256272 | 0.247868 | 0.505907 |
| White pattern W255 | 237.8529 | 248.5392 | 299.2667 |
| Red pattern R255 | 104.1608 | 52.7863 | 2.760134 |
| Green pattern G255 | 85.04818 | 177.6265 | 28.57739 |
| Blue pattern B255 | 48.4418 | 17.9489 | 267.6279 |

Then, the processing unit 14 multiplies the first updated parameters of each color pattern by a second gain factor to obtain a plurality of first adjusted parameters of each color pattern in the first picture P1 (step S20 in FIG. 2). In this embodiment, the processing unit 14 may take the aforesaid first gain factor to be the second gain factor.

In another embodiment, the processing unit 14 may calculate a ratio of each second original parameter to each first updated parameter of at least one of the white pattern W255, the red pattern R255, the green pattern G255 and the blue pattern B255 to obtain a plurality of ratios. Then, the processing unit 14 may take a specific value from the ratios to be the second gain factor, wherein the specific value may be a minimum value, a maximum value, an average value, a median value or other values. As shown in Table 7 below, the processing unit 14 may calculate a ratio of each second original parameter to each first updated parameter of the white pattern W255, the red pattern R255, the green pattern G255 and the blue pattern B255 to obtain a plurality of ratios. At this time, the specific value served as the second gain factor may be a minimum value 0.942741, a maximum value 0.962404, an average value 0.955524, a median value 0.956825 or other values in Table 7.

TABLE 7

| | Ratio of second original parameter to first updated parameter | | |
|---|---|---|---|
| Color pattern | X2/X1' | Y2/Y1' | Z2/Z1' |
| White pattern W255 | 0.953403 | 0.952506 | 0.960586 |
| Red pattern R255 | 0.943166 | 0.942741 | 0.962404 |
| Green pattern G255 | 0.961472 | 0.955056 | 0.952376 |
| Blue pattern B255 | 0.962262 | 0.958594 | 0.961724 |

In another embodiment, the processing unit 14 may calculate a ratio of each second original parameter to each first updated parameter of the white pattern W255 to obtain a plurality of ratios. Then, the processing unit 14 may take a matrix consisting of the ratios to be the second gain factor. As shown in Table 8 below, the matrix served as the second gain factor is [0.953403 0.952506 0.960586].

TABLE 8

| | Ratio of second original parameter to first updated parameter | | |
|---|---|---|---|
| Color pattern | X2/X1' | Y2/Y1' | Z2/Z1' |
| White pattern W255 | 0.953403 | 0.952506 | 0.960586 |

In another embodiment, a fourth matrix $$\begin{bmatrix} 104.1608 & 52.7863 & 2.760134 \\ 85.04818 & 177.6265 & 28.57739 \\ 48.4418 & 17.9489 & 267.6279 \end{bmatrix}$$

may consist of the first updated parameters of the red pattern R255, the green pattern G255 and the blue pattern B255, and a second matrix $$\begin{bmatrix} 98.24092 & 49.76382 & 2.656363 \\ 81.77143 & 169.6433 & 27.21642 \\ 46.6137 & 17.20572 & 257.3841 \end{bmatrix}$$

may consist of the second original parameters of the red pattern R255, the green pattern G255 and the blue pattern B255. Then, the processing unit 14 may multiply the second matrix by an inverse matrix of the fourth matrix and sets negative value(s) to be zero, so as to obtain a fifth matrix $$\begin{bmatrix} 0.943194 & 0 & 0.000215 \\ 0.006987 & 0.952993 & 0 \\ 0.000647 & 0 & 0.961772 \end{bmatrix}.$$

Then, the processing unit may take the fifth matrix to be the second gain factor.

If the maximum value 0.962152 in Table 3 is taken to be the second gain factor G2, the first adjusted parameters of each color pattern in the first picture P1 obtained in the step S20 are shown in Table 9 below.

TABLE 9

| First picture P1 | | | |
|---|---|---|---|
| | First adjusted parameter | | |
| Color pattern | X1" = X1' * G2 | Y1" = Y1' * G2 | Z1" = Z1' * G2 |
| Black pattern W0 | 0.246572 | 0.238487 | 0.48676 |
| White pattern W255 | 228.8507 | 239.1326 | 287.9402 |
| Red pattern R255 | 100.2185 | 50.78846 | 2.65567 |
| Green pattern G255 | 81.8293 | 170.9038 | 27.4958 |
| Blue pattern B255 | 46.60839 | 17.26958 | 257.4988 |

Referring to Table 10 below, Table 10 shows the difference of Y values (brightness values) of the white pattern W255 between the first picture P1 and the second picture P2 before and after adjusting the first picture P1. In Table 10, it is obvious that the brightness difference between the first picture P1 and the second picture P2 can be reduced effectively after adjusting the first picture P1 through the aforesaid method.

TABLE 10

| Color pattern | Before adjusting first picture P1 \|Y2 − Y1\| | After adjusting first picture P1 \|Y2 − Y1"\| |
|---|---|---|
| White pattern W255 | 11.81181 | 2.397469 |

Figure 3:
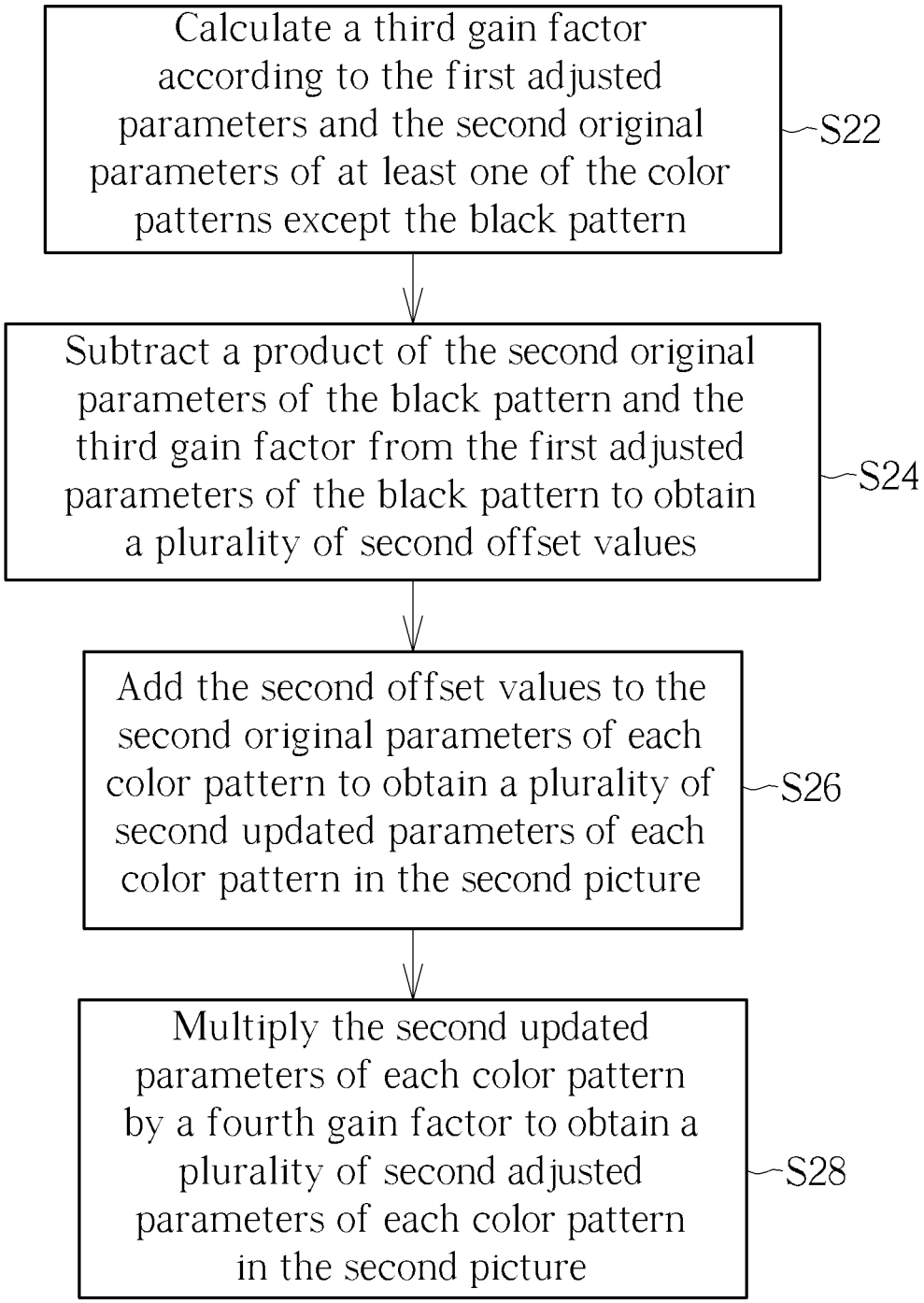
FIG. 3 is a flowchart illustrating a picture adjusting method according to another embodiment of the invention.

Referring to FIG. 3, FIG. 3 is a flowchart illustrating a picture adjusting method according to another embodiment of the invention. The picture adjusting method shown in FIG. 3 is also adapted to the display system 1 shown in FIG. 1. It should be noted that the step S22 in FIG. 3 is performed after the step S20 shown in FIG. 2.

After adjusting the brightness of the first picture P1 by the picture adjusting method shown in FIG. 2, the invention may further adjust the brightness of the second picture P2 by the picture adjusting method shown in FIG. 3. Thus, after the step S20, the processing unit 14 may calculate a third gain factor according to the first adjusted parameters and the second original parameters of at least one of the color patterns except the black pattern (step S22 in FIG. 3). In this embodiment, the processing unit 14 may calculate a ratio of each first adjusted parameter to each second original parameter of at least one of the white pattern W255, the red pattern R255, the green pattern G255 and the blue pattern B255 to obtain a plurality of ratios. Then, the processing unit 14 may take a specific value from the ratios to be the third gain factor, wherein the specific value may be a minimum value, a maximum value, an average value, a median value or other values. As shown in Table 11 below, the processing unit 14 may calculate a ratio of each first adjusted parameter to each second original parameter of the white pattern W255, the red pattern R255, the green pattern G255 and the blue pattern B255 to obtain a plurality of ratios. At this time, the specific value served as the third gain factor may be a minimum value 0.999739, a maximum value 1.02059, an average value 1.006987, a median value 1.005571 or other values in Table 11.

TABLE 11

| | Ratio of first adjusted parameter to second original parameter | | |
|---|---|---|---|
| Color pattern | X1"/X2 | Y1"/Y2 | Z1"/Z2 |
| White pattern W255 | 1.009177 | 1.010127 | 1.001631 |
| Red pattern R255 | 1.02013 | 1.02059 | 0.999739 |
| Green pattern G255 | 1.000708 | 1.00743 | 1.010265 |
| Blue pattern B255 | 0.999886 | 1.003712 | 1.000446 |

In another embodiment, the processing unit 14 may calculate a ratio of each first adjusted parameter to each second original parameter of the white pattern W255 to obtain a plurality of ratios. Then, the processing unit 14 may take a matrix consisting of the ratios to be the third gain factor. As shown in Table 12 below, the matrix served as the third gain factor is [1.009177 1.010127 1.001631]. Needless to say, the processing unit 14 may also take a minimum value, a maximum value, an average value, a median value or other values in Table 12 to be the third gain factor.

TABLE 12

| | Ratio of first adjusted parameter to second original parameter | | |
|---|---|---|---|
| Color pattern | X1"/X2 | Y1"/Y2 | Z1"/Z2 |
| White pattern W255 | 1.009177 | 1.010127 | 1.001631 |

In another embodiment, a sixth matrix $$\begin{bmatrix} 100.2185 & 50.78846 & 2.65567 \\ 81.8293 & 170.9038 & 27.4958 \\ 46.60839 & 17.26958 & 257.4988 \end{bmatrix}$$

may consist of the first adjusted parameters of the red pattern R255, the green pattern G255 and the blue pattern B255, and a second matrix $$\begin{bmatrix} 98.24092 & 49.76382 & 2.656363 \\ 81.77143 & 169.6433 & 27.21642 \\ 46.6137 & 17.20572 & 257.3841 \end{bmatrix}$$

may consist of the second original parameters of the red pattern R255, the green pattern G255 and the blue pattern B255. Then, the processing unit 14 may multiply the sixth matrix by an inverse matrix of the second matrix and sets negative value(s) to be zero, so as to obtain a seventh matrix $$\begin{bmatrix} 1.020099 & 0.000167 & 0 \\ 0 & 1.009609 & 0.000147 \\ 0 & 0.000539 & 1.000396 \end{bmatrix}.$$

Then, the processing unit may take the seventh matrix to be the third gain factor.

In the following, the minimum value 1.001631 in Table 12 is taken to be the third gain factor to illustrate the steps after the step S22. After obtaining the third gain factor, the processing unit 14 subtracts a product of the second original parameters of the black pattern W0 and the third gain factor from the first adjusted parameters of the black pattern W0 to obtain a plurality of second offset values (step S24 in FIG. 3). It is assumed that the third gain factor is represented by G3, so the calculation and result of the second offset values are shown in Table 13 below.

TABLE 13

| Black pattern | Subtract product of second original parameter and third gain factor from first adjusted parameter | | |
|---|---|---|---|
| W0 | X1" − X2 * G3 | Y1" − Y2 * G3 | Z1" − Z2 * G3 |
| Second offset value | −0.00019 | −0.000097 | −0.00039 |

Then, the processing unit 14 adds the second offset values to the second original parameters of each color pattern to obtain a plurality of second updated parameters of each color pattern in the second picture P2 (step S26 in FIG. 3), as shown in Table 14 below.

TABLE 14

| Second picture P2 | | | |
|---|---|---|---|
| | Second updated parameter | | |
| Color pattern | X2' = X2 − 0.00019 | Y2' = Y2 − 0.000097 | Z2' = Z2 − 0.00039 |
| Black pattern W0 | 0.24617 | 0.238098 | 0.485966 |
| White pattern W255 | 226.7694 | 236.735 | 287.471 |
| Red pattern R255 | 98.24072 | 49.76372 | 2.655973 |
| Green pattern G255 | 81.77124 | 169.6432 | 27.21603 |
| Blue pattern B255 | 46.61351 | 17.20562 | 257.3837 |

Then, the processing unit 14 multiplies the second updated parameters of each color pattern by a fourth gain factor to obtain a plurality of second adjusted parameters of each color pattern in the second picture P2 (step S28 in FIG. 3). In this embodiment, the processing unit 14 may take the aforesaid third gain factor to be the fourth gain factor.

In another embodiment, the processing unit 14 may calculate a ratio of each first adjusted parameter to each second updated parameter of at least one of the white pattern W255, the red pattern R255, the green pattern G255 and the blue pattern B255 to obtain a plurality of ratios. Then, the processing unit 14 may take a specific value from the ratios to be the fourth gain factor, wherein the specific value may be a minimum value, a maximum value, an average value, a median value or other values. As shown in Table 15 below, the processing unit 14 may calculate a ratio of each first adjusted parameter to each second updated parameter of the white pattern W255, the red pattern R255, the green pattern G255 and the blue pattern B255 to obtain a plurality of ratios. At this time, the specific value served as the fourth gain factor may be a minimum value 0.999886, a maximum value 1.020592, an average value 1.007002, a median value 1.005574 or other values in Table 15.

TABLE 15

| | Ratio of first adjusted parameter to second updated parameter | | |
|---|---|---|---|
| Color pattern | X1"/X2' | Y1"/Y2' | Z1"/Z2' |
| White pattern W255 | 1.009178 | 1.010128 | 1.001632 |
| Red pattern R255 | 1.020132 | 1.020592 | 0.999886 |
| Green pattern G255 | 1.00071 | 1.007431 | 1.010128 |
| Blue pattern B255 | 0.99989 | 1.003717 | 1.000447 |

In another embodiment, the processing unit 14 may calculate a ratio of each first adjusted parameter to each second updated parameter of the white pattern W255 to obtain a plurality of ratios. Then, the processing unit 14 may take a matrix consisting of the ratios to be the fourth gain factor. As shown in Table 16 below, the matrix served as the fourth gain factor is [1.009178 1.010128 1.001632].

TABLE 16

| | Ratio of first adjusted parameter to second updated parameter | | |
|---|---|---|---|
| Color pattern | X1"/X2' | Y1"/Y2' | Z1"/Z2' |
| White pattern W255 | 1.009178 | 1.010128 | 1.001632 |

In another embodiment, a sixth matrix $$\begin{bmatrix} 100.2185 & 50.78846 & 2.65567 \\ 81.8293 & 170.9038 & 27.4958 \\ 46.60839 & 17.26958 & 257.4988 \end{bmatrix}$$

may consist of the first adjusted parameters of the red pattern R255, the green pattern G255 and the blue pattern B255, and an eighth matrix $$\begin{bmatrix} 98.24072 & 49.76372 & 2.655973 \\ 81.77124 & 169.6432 & 27.21603 \\ 46.61351 & 17.20562 & 257.3837 \end{bmatrix}$$

may consist of the second updated parameters of the red pattern R255, the green pattern G255 and the blue pattern B255. Then, the processing unit 14 may multiply the sixth matrix by an inverse matrix of the eighth matrix and sets negative value(s) to be zero, so as to obtain a ninth matrix $$\begin{bmatrix} 1.0201 & 0.000167 & 0 \\ 0 & 1.009609 & 0.000148 \\ 0 & 0.000539 & 1.000397 \end{bmatrix}.$$

Then, the processing unit may take the ninth matrix to be the fourth gain factor.

If the ninth matrix $$\begin{bmatrix} 1.0201 & 0.000167 & 0 \\ 0 & 1.009609 & 0.000148 \\ 0 & 0.000539 & 1.000397 \end{bmatrix}$$

is taken to be the fourth gain factor G4, the second adjusted parameters of each color pattern in the second picture P2 obtained in the step S28 are shown in Table 17 below.

TABLE 17

| | Second picture P2 | | |
|---|---|---|---|
| | Second adjusted parameter | | |
| Color pattern | X2" = X2' * G4 | Y2" = Y2' * G4 | Z2" = Z2' * G4 |
| Black pattern W0 | 0.251119 | 0.24069 | 0.486195 |
| White pattern W255 | 231.3275 | 239.2028 | 287.6202 |
| Red pattern R255 | 100.2154 | 50.25979 | 2.664394 |
| Green pattern G255 | 83.41486 | 171.3017 | 27.25195 |
| Blue pattern B255 | 47.55045 | 17.51745 | 257.4885 |

Referring to Table 18 below, Table 18 shows the difference of Y values (brightness values) of the white pattern W255 between the first picture P1 and the second picture P2 before and after adjusting the first picture P1 and the second picture P2. In Table 18, it is obvious that the brightness difference between the first picture P1 and the second picture P2 can be further reduced after adjusting the first picture P1 and the second picture P2 through the aforesaid method.

TABLE 18

| Color pattern | Before adjusting first picture P1 and second picture P2 \|Y2 − Y1\| | After adjusting first picture P1 and second picture P2 \|Y2" − Y1"\| |
|---|---|---|
| White pattern W255 | 11.81181 | 0.070171 |

As mentioned in the above, when displaying two pictures, the invention calculates the gain factors and the offset values according to the color patterns (e.g. black pattern, white pattern, red pattern, green pattern, blue pattern, etc.) in the two pictures and then adjusts the original parameters of each color pattern by the gain factors and the offset values. Accordingly, the invention can reduce brightness difference between the two pictures, such that the user will not feel obvious difference in vision as watching the two pictures.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A picture adjusting method comprising steps of:

displaying a first picture and a second picture;

measuring a plurality of first original parameters in the first picture and measuring a plurality of second original parameters in the second picture for each of a plurality of color patterns, wherein the color patterns comprise a black pattern and parameter of the black pattern is other than zero;

calculating a first gain factor according to the first original parameters and the second original parameters of at least one of the color patterns except the black pattern;

subtracting a product of the first original parameters of the black pattern and the first gain factor from the second original parameters of the black pattern to obtain a plurality of first offset values;

adding the first offset values to the first original parameters of each color pattern to obtain a plurality of first updated parameters of each color pattern in the first picture; and multiplying the first updated parameters of each color pattern by a second gain factor to obtain a plurality of first adjusted parameters of each color pattern in the first picture.

2. The picture adjusting method of claim 1, wherein the color patterns comprise a white pattern, a red pattern, a green pattern and a blue pattern, the picture adjusting method further comprises steps of:

calculating a ratio of each second original parameter to each first original parameter of at least one of the white pattern, the red pattern, the green pattern and the blue pattern to obtain a plurality of ratios; and taking a specific value from the ratios to be the first gain factor.

3. The picture adjusting method of claim 1, wherein the color patterns comprise a white pattern, the picture adjusting method further comprises steps of:

calculating a ratio of each second original parameter to each first original parameter of the white pattern to obtain a plurality of ratios; and taking a matrix consisting of the ratios to be the first gain factor.

4. The picture adjusting method of claim 1, wherein the color patterns comprise a red pattern, a green pattern and a blue pattern, a first matrix consists of the first original parameters of the red pattern, the green pattern and the blue pattern, a second matrix consists of the second original parameters of the red pattern, the green pattern and the blue pattern, the picture adjusting method further comprises steps of:

multiplying the second matrix by an inverse matrix of the first matrix and setting negative value(s) to be zero, so as to obtain a third matrix; and taking the third matrix to be the first gain factor.

5. The picture adjusting method of claim 1, further comprising step of:

taking the first gain factor to be the second gain factor.

6. The picture adjusting method of claim 1, wherein the color patterns comprise a white pattern, a red pattern, a green pattern and a blue pattern, the picture adjusting method further comprises steps of:

calculating a ratio of each second original parameter to each first updated parameter of at least one of the white pattern, the red pattern, the green pattern and the blue pattern to obtain a plurality of ratios; and taking a specific value from the ratios to be the second gain factor.

7. The picture adjusting method of claim 1, wherein the color patterns comprise a white pattern, the picture adjusting method further comprises steps of:

calculating a ratio of each second original parameter to each first updated parameter of the white pattern to obtain a plurality of ratios; and taking a matrix consisting of the ratios to be the second gain factor.

8. The picture adjusting method of claim 1, wherein the color patterns comprise a red pattern, a green pattern and a blue pattern, a fourth matrix consists of the first updated parameters of the red pattern, the green pattern and the blue pattern, a second matrix consists of the second original parameters of the red pattern, the green pattern and the blue pattern, the picture adjusting method further comprises steps of:

multiplying the second matrix by an inverse matrix of the fourth matrix and setting negative value(s) to be zero, so as to obtain a fifth matrix; and taking the fifth matrix to be the second gain factor.

9. The picture adjusting method of claim 1, further comprising steps of:

calculating a third gain factor according to the first adjusted parameters and the second original parameters of at least one of the color patterns except the black pattern;

subtracting a product of the second original parameters of the black pattern and the third gain factor from the first adjusted parameters of the black pattern to obtain a plurality of second offset values;

adding the second offset values to the second original parameters of each color pattern to obtain a plurality of second updated parameters of each color pattern in the second picture; and multiplying the second updated parameters of each color pattern by a fourth gain factor to obtain a plurality of second adjusted parameters of each color pattern in the second picture.

10. The picture adjusting method of claim 9, wherein the color patterns comprise a white pattern, a red pattern, a green pattern and a blue pattern, the picture adjusting method further comprises steps of:

calculating a ratio of each first adjusted parameter to each second original parameter of at least one of the white pattern, the red pattern, the green pattern and the blue pattern to obtain a plurality of ratios; and taking a specific value from the ratios to be the third gain factor.

11. The picture adjusting method of claim 9, wherein the color patterns comprise a white pattern, the picture adjusting method further comprises steps of:

calculating a ratio of each first adjusted parameter to each second original parameter of the white pattern to obtain a plurality of ratios; and taking a matrix consisting of the ratios to be the third gain factor.

12. The picture adjusting method of claim 9, wherein the color patterns comprise a red pattern, a green pattern and a blue pattern, a sixth matrix consists of the first adjusted parameters of the red pattern, the green pattern and the blue pattern, a second matrix consists of the second original parameters of the red pattern, the green pattern and the blue pattern, the picture adjusting method further comprises steps of:

multiplying the sixth matrix by an inverse matrix of the second matrix and setting negative value(s) to be zero, so as to obtain a seventh matrix; and taking the seventh matrix to be the third gain factor.

13. The picture adjusting method of claim 9, further comprising step of:

taking the third gain factor to be the fourth gain factor.

14. The picture adjusting method of claim 9, wherein the color patterns comprise a white pattern, a red pattern, a green pattern and a blue pattern, the picture adjusting method further comprises steps of:

calculating a ratio of each first adjusted parameter to each second updated parameter of at least one of the white pattern, the red pattern, the green pattern and the blue pattern to obtain a plurality of ratios; and taking a specific value from the ratios to be the fourth gain factor.

15. The picture adjusting method of claim 9, wherein the color patterns comprise a white pattern, the picture adjusting method further comprises steps of:

calculating a ratio of each first adjusted parameter to each second updated parameter of the white pattern to obtain a plurality of ratios; and taking a matrix consisting of the ratios to be the fourth gain factor.

16. The picture adjusting method of claim 9, wherein the color patterns comprise a red pattern, a green pattern and a blue pattern, a sixth matrix consists of the first adjusted parameters of the red pattern, the green pattern and the blue pattern, an eighth matrix consists of the second updated parameters of the red pattern, the green pattern and the blue pattern, the picture adjusting method further comprises steps of:

multiplying the sixth matrix by an inverse matrix of the eighth matrix and setting negative value (s) to be zero, so as to obtain a ninth matrix; and taking the ninth matrix to be the fourth gain factor.

17. A display system comprising:

a display module displaying a first picture and a second picture;

a measuring unit measuring a plurality of first original parameters in the first picture and measuring a plurality of second original parameters in the second picture for each of a plurality of color patterns, wherein the color patterns comprise a black pattern and parameter of the black pattern is other than zero; and a processing unit calculating a first gain factor according to the first original parameters and the second original parameters of at least one of the color patterns except the black pattern, the processing unit subtracting a product of the first original parameters of the black pattern and the first gain factor from the second original parameters of the black pattern to obtain a plurality of first offset values, the processing unit adding the first offset values to the first original parameters of each color pattern to obtain a plurality of first updated parameters of each color pattern in the first picture, the processing unit multiplying the first updated parameters of each color pattern by a second gain factor to obtain a plurality of first adjusted parameters of each color pattern in the first picture.

18. The display system of claim 17, wherein the color patterns comprise a white pattern, a red pattern, a green pattern and a blue pattern, the processing unit calculates a ratio of each second original parameter to each first original parameter of at least one of the white pattern, the red pattern, the green pattern and the blue pattern to obtain a plurality of ratios, and the processing unit takes a specific value from the ratios to be the first gain factor.

19. The display system of claim 17, wherein the color patterns comprise a white pattern, the processing unit calculates a ratio of each second original parameter to each first original parameter of the white pattern to obtain a plurality of ratios, and the processing unit takes a matrix consisting of the ratios to be the first gain factor.

20. The display system of claim 17, wherein the color patterns comprise a red pattern, a green pattern and a blue pattern, a first matrix consists of the first original parameters of the red pattern, the green pattern and the blue pattern, a second matrix consists of the second original parameters of the red pattern, the green pattern and the blue pattern, the processing unit multiplies the second matrix by an inverse matrix of the first matrix and sets negative value(s) to be zero, so as to obtain a third matrix, and the processing unit takes the third matrix to be the first gain factor.

21. The display system of claim 17, wherein the processing unit takes the first gain factor to be the second gain factor.

22. The display system of claim 17, wherein the color patterns comprise a white pattern, a red pattern, a green pattern and a blue pattern, the processing unit calculates a ratio of each second original parameter to each first updated parameter of at least one of the white pattern, the red pattern, the green pattern and the blue pattern to obtain a plurality of ratios, and the processing unit takes a specific value from the ratios to be the second gain factor.

23. The display system of claim 17, wherein the color patterns comprise a white pattern, the processing unit calculates a ratio of each second original parameter to each first updated parameter of the white pattern to obtain a plurality of ratios, and the processing unit takes a matrix consisting of the ratios to be the second gain factor.

24. The display system of claim 17, wherein the color patterns comprise a red pattern, a green pattern and a blue pattern, a fourth matrix consists of the first updated parameters of the red pattern, the green pattern and the blue pattern, a second matrix consists of the second original parameters of the red pattern, the green pattern and the blue pattern, the processing unit multiplies the second matrix by an inverse matrix of the fourth matrix and sets negative value(s) to be zero, so as to obtain a fifth matrix, and the processing unit takes the fifth matrix to be the second gain factor.

25. The display system of claim 17, wherein the processing unit calculates a third gain factor according to the first adjusted parameters and the second original parameters of at least one of the color patterns except the black pattern, the processing unit subtracts a product of the second original parameters of the black pattern and the third gain factor from the first adjusted parameters of the black pattern to obtain a plurality of second offset values, the processing unit adds the second offset values to the second original parameters of each color pattern to obtain a plurality of second updated parameters of each color pattern in the second picture, and the processing unit multiplies the second updated parameters of each color pattern by a fourth gain factor to obtain a plurality of second adjusted parameters of each color pattern in the second picture.

26. The display system of claim 25, wherein the color patterns comprise a white pattern, a red pattern, a green pattern and a blue pattern, the processing unit calculates a ratio of each first adjusted parameter to each second original parameter of at least one of the white pattern, the red pattern, the green pattern and the blue pattern to obtain a plurality of ratios, and the processing unit takes a specific value from the ratios to be the third gain factor.

27. The display system of claim 25, wherein the color patterns comprise a white pattern, the processing unit calculates a ratio of each first adjusted parameter to each second original parameter of the white pattern to obtain a plurality of ratios, and the processing unit takes a matrix consisting of the ratios to be the third gain factor.

28. The display system of claim 25, wherein the color patterns comprise a red pattern, a green pattern and a blue pattern, a sixth matrix consists of the first adjusted parameters of the red pattern, the green pattern and the blue pattern, a second matrix consists of the second original parameters of the red pattern, the green pattern and the blue pattern, the processing unit multiplies the sixth matrix by an inverse matrix of the second matrix and sets negative value(s) to be zero, so as to obtain a seventh matrix, and the processing unit takes the seventh matrix to be the third gain factor.

29. The display system of claim 25, wherein the processing unit takes the third gain factor to be the fourth gain factor.

30. The display system of claim 25, wherein the color patterns comprise a white pattern, a red pattern, a green pattern and a blue pattern, the processing unit calculates a ratio of each first adjusted parameter to each second updated parameter of at least one of the white pattern, the red pattern, the green pattern and the blue pattern to obtain a plurality of ratios, and the processing unit takes a specific value from the ratios to be the fourth gain factor.

31. The display system of claim 25, wherein the color patterns comprise a white pattern, the processing unit calculates a ratio of each first adjusted parameter to each second updated parameter of the white pattern to obtain a plurality of ratios, and the processing unit takes a matrix consisting of the ratios to be the fourth gain factor.

32. The display system of claim 25, wherein the color patterns comprise a red pattern, a green pattern and a blue pattern, a sixth matrix consists of the first adjusted parameters of the red pattern, the green pattern and the blue pattern, an eighth matrix consists of the second updated parameters of the red pattern, the processing unit multiplies the sixth matrix by an inverse matrix of the eighth matrix and sets negative value(s) to be zero, so as to obtain a ninth matrix, and the processing unit takes the ninth matrix to be the fourth gain factor.

* * * * *